US005201329A

United States Patent [19]

Quackenbush

[11] Patent Number: 5,201,329

[45] Date of Patent: Apr. 13, 1993

[54] PERMANENT WAVE ROD HAVING HINGED END-CAP

[76] Inventor: Claire Quackenbush, 2060 Skyhawk Ct., Mt. Pleasant, S.C. 29464

[21] Appl. No.: 823,357

[22] Filed: Jan. 21, 1992

[51] Int. Cl.[5] ..... A45D 2/14

[52] U.S. Cl. ..... 132/248; 132/249; 132/250; 132/255

[58] Field of Search ..... 132/245, 248, 249, 250, 132/254, 255

[56] References Cited

U.S. PATENT DOCUMENTS

| | | | |
|---|---|---|---|
| 2,825,344 | 3/1958 | Lenois | 132/250 |
| 2,874,706 | 2/1959 | Ficicchy | 132/250 |
| 3,933,161 | 1/1976 | Strickman et al. | 132/255 |
| 4,108,183 | 8/1978 | Mauro | 132/250 |
| 4,240,451 | 12/1980 | Thompson | 132/250 |
| 4,465,085 | 8/1984 | Schopieray | 132/248 |

FOREIGN PATENT DOCUMENTS

| | | | |
|---|---|---|---|
| 0171682 | 2/1986 | European Pat. Off. | 132/248 |

*Primary Examiner*—Gene Mancene
*Assistant Examiner*—Frank A. LaViola
*Attorney, Agent, or Firm*—B. Craig Killough

[57] ABSTRACT

A permanent wave rod having an elastic band to which tension is applied to hold the permanent wave rod in place against hair. Tension is applied to the elastic band by an end cap which is pivotally attached to the body of the permanent wave rod, and which is pivoted toward the body to apply tension to the elastic band, and is pivoted away from the body to release tension from the elastic band.

6 Claims, 1 Drawing Sheet

PERMANENT WAVE ROD HAVING HINGED END-CAP

BACKGROUND OF THE INVENTION

This invention relates to hairstyling devices generally, and is specifically directed to a permanent wave rod having an improved means for applying tension to an elastic band which is used to hold the permanent wave rod in place against the hair.

Various devices known as rollers or permanent wave rods are used in hairstyling to add curl to hair. Rollers or permanent wave rods are comprised of generally cylindrical bodies, around which hair is wrapped or rolled, so as to curl the hair. Various devices, such as clips, or bands having elastic properties, are used to hold the roller or permanent wave rod in place against the hair.

Permanent wave rods are used in hairstyling to create what is known as a permanent. "Permanent" hair curl is produced by placing the desired number of permanent wave rods in the hair while introducing to the hair various compositions which will cause the curl produced by the permanent wave rod to be present in the hair for an extended period of time. One common process of creating a permanent is known as the permanent cold wave process.

Permanent wave rods in common use in the prior art are characterized by a generally cylindrical body. The body may have a concave aspect to it, that is, the diameter of the rod may be relatively small in the center of the rod, while increasing to the largest diameter at the ends of the rod. Permanent wave rods come in various diameters to produce the desired wave or curl effect.

One embodiment of the prior art in common use has a generally cylindrical body with a band having an elastic property running longitudinally along the length of the body. The elastic band is held on one end of the rod by placing the elastic band within a slot. The opposite end of the elastic band is attached to an end cap which typically has a male member which is inserted into an aperture within the body.

With the male member of the end cap removed from the aperture, hair may be wrapped around the permanent wave rod as required. The end cap is then positioned against the permanent wave rod by inserting the male member into the aperture, causing tension to be produced in the elastic band. The tension of the elastic band against the hair and the permanent wave rod causes the permanent wave rod to be held in place.

Permanent wave solutions tend to have a lubricant quality, making it very difficult to handle devices such as the permanent wave rod. The permanent wave rod of the type in the prior art as described above requires a great deal of manual dexterity to roll the hair, then insert the cap into the aperture. Manual dexterity is reduced due to the nature of the permanent wave solution. Further, if a rubber band breaks or is need of replacement, the rubber band must be placed in slots or other positioning means on both ends of the permanent wave rod. Again, this operation requires fine motor skills, and dexterity is 2 reduced by the permanent wave solution.

SUMMARY OF THE PRESENT INVENTION

The present invention provides a pivotal end cap 2 which can be pivoted about a point of attachment 4 to the body 6 and away from the permanent wave rod to reduce tension on the elastic band 8. Hair may easily be placed between the elastic band and the body and rolled, with the end cap 2 then pivoted back toward the body to apply tension to the elastic band to hold the permanent wave rod in place. Means is provided to hold the end cap 2 in place, applying tension to the elastic band for the period required. To remove the permanent wave rod from the hair, the end cap may again be pivoted away from the body to relieve the tension from the elastic band. The present invention provides a permanent wave rod which does not require the alignment of a male member with an aperture, and the insertion of the end cap into the aperture.

DESCRIPTION OF THE PREFERRED EMBODIMENT

Figure 2:
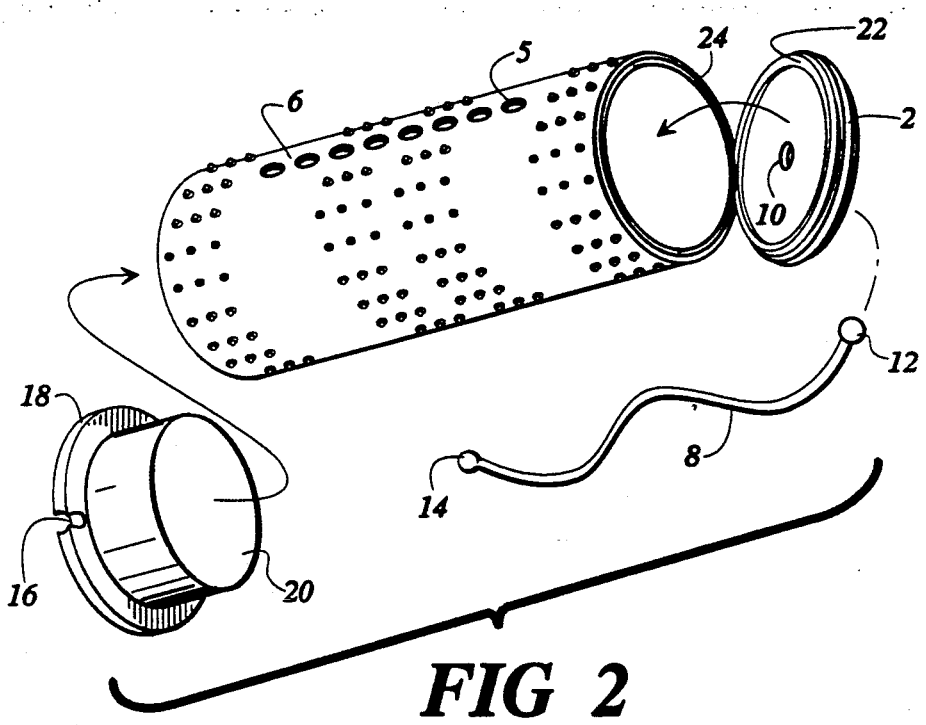
FIG. 2 is an exploded view of the permanent wave rod of FIG. 1, demonstrating the elements of the permanent wave rod.

FIG. 2 discloses the elements of the device. In the preferred embodiment, the device comprises a generally cylindrical body 6 which is preferably hollow. The body 6 may have a plurality of protrusions from the body to aid in gripping and holding the hair while it is rolled. A series of voids 5 may be provided within the body if desired.

As shown, the body is of constant diameter. In the prior art, it is common to use bodies which are concave when viewed from the side, that is, the body has a relatively small diameter in the center of the body, which increases toward the ends. Virtually any desired body shape could be used.

A pivotal end cap 2 is attached to one end of the body. Pivotal attachment means such as a hinge 4 allows the pivotal end cap 2 to be pivoted away from the body to decrease tension on the elastic band 8, as will be seen, or to be pivoted toward the body and attached to the body to increase tension on the elastic band.

Figure 1:
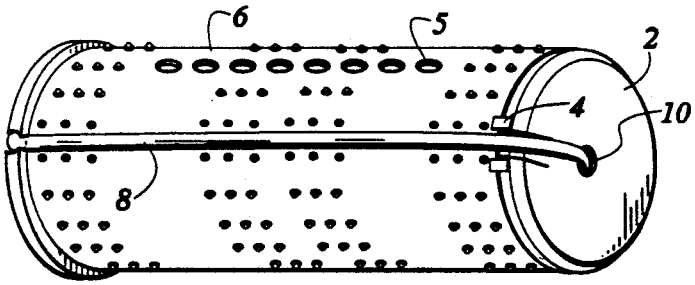
FIG. 1 is a perspective view of the permanent wave rod with the elastic band attached to one end of the permanent wave rod and attached to the opposite end of the body of the permanent wave rod by means of the pivotal end cap.

The elastic band 8 traverses the body 6 longitudinally as is shown in FIG. 1. The elastic band may be made of any material having an elastic property which will cause the band to stretch and apply force to the body as the end cap is pivoted and fixed in place against the body. The elastic band can be made of rubber, either alone or in combination with other materials, or synthetic rubber, or any other similar material having the desired elastic property.

In the preferred embodiment, the elastic band is designed for easy change. The elastic band will, over time, become worn or lose its elastic property, and it is necessary from time to time to change the elastic band. As shown, the elastic band is pulled through an aperture 10 in the pivotal end cap 2. An end 12 of the elastic band 8 which is larger than the aperture 10 causes the elastic band to be held in place against the inner surface of the pivotal end cap. The opposite end, which has a smaller enlarged end 14, is attached to the opposite end of the body, such as by the slot shown in FIGS. 1 and 3.

In the preferred embodiment, an end cap 18 is used on the end of the body opposite the pivotal end cap. This end cap 18 has a male member 20 which is inserted into an aperture of the body resulting from the hollow nature of the body of the preferred embodiment. End 14 of the elastic band is inserted in slot 16 within the end cap. The use of the removable end cap allows flexibility in use of the device. However, it is not necessary for the end cap to be removable. The elastic band could be attached to the end of the body opposite the pivotal end cap by any known means.

Figure 3:
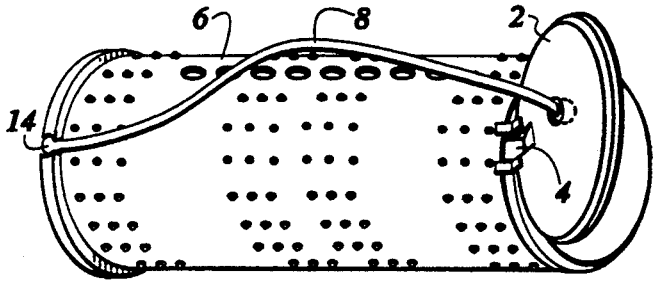
FIG. 3 is the permanent wave rod of FIG. 1, with the pivotal end cap pivoted away from the body of the permanent wave rod to remove tension from the elastic band.

To use the device, the pivotal end cap is pivoted from the position shown in FIG. 1 to the position shown in FIG. 3. Hair is inserted between the body and the elastic band, and the hair is rolled about the permanent wave rod. The end cap is then pivoted from the position shown in FIG. 3 to the position shown in FIG. 1.

As the pivotal end cap is pivoted toward the body to the position as shown in FIG. 1, tension is applied to the elastic band. The elastic band holds the body against the hair, keeping the permanent wave rod in place for a desired period of time. To remove the permanent wave rod from the hair, the end cap is then pivoted away from the body to remove the tension from the elastic band, to allow the permanent wave rod to be removed from the hair.

An attachment means is provided to hold the pivotal end cap in place against the body as shown in FIG. 1. As shown in the preferred embodiment, a lip 22 running about the circumference of the pivotal end cap engages a groove 24 formed within the body. The body and the pivotal end cap, which are normally made of plastic, deform sufficiently to allow the cap to be snapped in place against the body. Any known means of attaching such devices could be employed. It is desired that the pivotal end cap be capable of attachment to the body by easy to use manual means. The attachment means of caps to various types of containers could be employed to achieve the desired result.

What is claimed is:

1. A permanent wave rod, comprising:

a. a generally cylindrical body;

b. a pivotal end cap which is attached to an end of said body and which is capable of pivoting relative to said body at a hinged point of attachment to said body, said pivotal end cap being of a generally flat, planar construction; and c. an elastic band which is attached at one end thereof to an end of said body and which is attached at an opposite end thereof to said pivotal end cap, wherein said pivotal end cap is pivoted away from said body to remove tension from said elastic band to allow hair to be placed underneath said elastic band, and wherein said pivotal end cap is pivoted toward said body to apply tension to said elastic band so as to hold said permanent wave rod against said hair.

2. A permanent wave rod as described in claim 1, wherein said pivotal end cap has a fastening means which allows said end cap to be removably fastened to said body to prevent said pivotal end cap from pivoting away from said body.

3. A permanent wave rod as described in claim 1, wherein said elastic band is removably attached to said body.

4. A permanent wave rod as described in claim 2, wherein said elastic band is removably attached to said body.

5. A permanent wave rod as described in claim 1, further comprising a second end cap which is attached to said opposite end of said body, and to which said elastic band is removably attached.

6. A permanent wave rod as described in claim 2, further comprising a second end cap which is attached to said opposite end of said body, and to which said elastic band is removably attached.

* * * * *